US009835381B2

(12) United States Patent
Toma

(10) Patent No.: US 9,835,381 B2
(45) **Date of Patent: *Dec. 5, 2017**

(54) DOUBLE WALLED EVAPORATOR WITH HEAT EXCHANGE

(71) Applicant: Hani Toma, El Cajon, CA (US)

(72) Inventor: Hani Toma, El Cajon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/398,550

(22) Filed: Jan. 4, 2017

(65) Prior Publication Data

US 2017/0115070 A1 Apr. 27, 2017

Related U.S. Application Data

(63) Continuation of application No. 14/799,425, filed on Jul. 14, 2015, now Pat. No. 9,568,229.

(60) Provisional application No. 62/024,463, filed on Jul. 14, 2014.

(51) Int. Cl.

| | |
|---|---|
| ***F25B 41/00*** | (2006.01) |
| ***F25B 39/02*** | (2006.01) |
| ***F28D 7/10*** | (2006.01) |
| ***F28D 7/16*** | (2006.01) |
| ***F25C 1/00*** | (2006.01) |
| ***F25C 1/14*** | (2006.01) |
| ***F25C 1/12*** | (2006.01) |
| ***F28F 9/02*** | (2006.01) |
| *F25C 1/06* | (2006.01) |
| *F28D 21/00* | (2006.01) |
| *F25C 5/10* | (2006.01) |

(52) U.S. Cl.

CPC ..... *F28D 7/1669* (2013.01); *F25B 39/02* (2013.01); *F25C 1/00* (2013.01); *F25C 1/12* (2013.01); *F25C 1/145* (2013.01); *F28F 9/026* (2013.01); *F25B 2339/0242* (2013.01); *F25C 1/06* (2013.01); *F25C 5/10* (2013.01); *F28D 2021/0071* (2013.01)

(58) Field of Classification Search

CPC . F25C 1/145; F28D 7/1669; F25B 2339/0242
See application file for complete search history.

(56) References Cited

U.S. PATENT DOCUMENTS

| | | | | |
|---|---|---|---|---|
| 3,760,870 A * | 9/1973 | Guetlhuber | ..... | B01J 8/067 165/103 |
| 7,172,737 B2 * | 2/2007 | Rong | ..... | B01J 8/008 422/129 |
| 2005/0129593 A1 * | 6/2005 | Hotta | ..... | B01D 53/74 422/198 |

* cited by examiner

*Primary Examiner* — Allen Flanigan
*Assistant Examiner* — Filip Zec
(74) *Attorney, Agent, or Firm* — Reem Allos

(57) ABSTRACT

An apparatus covering an evaporator on all four sides. a first inlet to allow refrigerant into the casing. A side chamber, a top chamber, a center chamber, and a bottom chamber to receive refrigerant and act as a heat exchange allowing the refrigerant received to undergo heat transfer and reduction in temperature due to thermal exchange with a plurality of side of the evaporator. A first outlet to allowing the refrigerant to exit the casing. A second inlet to allow the refrigerant to enter the evaporator after exiting the casing and distribute the refrigerant within the evaporator. A second outlet allowing the refrigerant to exit the evaporator and cycle through a refrigeration system. The first inlet and the second outlet are dual-piped to allow for heat exchange. The evaporator, comprising a plurality of tubes, optionally, space reducers, and optionally, a center space reducer.

20 Claims, 10 Drawing Sheets

DOUBLE WALLED EVAPORATOR WITH HEAT EXCHANGE

CROSS-REFERENCE TO RELATED APPLICATIONS

The present application claims the benefit of: U.S. Non-Provisional patent application Ser. No. 14/799,425 filed on Jul. 14, 2015 and U.S. Provisional Patent Application Ser. No. 62/024,463 filed Jul. 14, 2014 and entitled "EVAPORATOR WITH HEAT EXCHANGE" hereby expressly incorporated by reference in their entirety. Furthermore, any and all priority claims identified in the Application Data Sheet, or any correction thereto, are hereby incorporated by reference under 37 C.F.R. §1.57.

FIELD OF THE INVENTION

The present invention relates to automatic ice making systems, with particular focus onto the evaporator and assembly.

BACKGROUND OF THE INVENTION

Automatic ice machine systems are comprised of a refrigeration system, which is comprised of at least one compressor, at least one condenser, at least one receiver, at least one evaporator, and refrigerant which cycles through the refrigeration system in a controlled manner in order to systematically produce ice for harvesting. A portion of the refrigeration cycle includes the refrigerant traveling from the receiver to the evaporator wherein the refrigerant undergoes a transformative process during the entrance into the chamber of the evaporator, the evaporator's chamber intent is to freeze received liquid into ice. A lot of energy is used to convert the hot vapor refrigerant into its cooler counterpart prior to entrance into the evaporator. There is a need for the refrigerant to undergo a cooling process prior to entrance into the chamber of the evaporator so as to reduce the time and energy costs associated with refrigerant cooling process.

SUMMARY OF THE INVENTION

In one inventive aspect, there is an evaporator with heat exchange apparatus. The apparatus includes, a first inlet means to allow refrigerant into a casing covering an evaporator. The apparatus also includes, an evaporator with a plurality of parallel tubes longitudinally disposed within the evaporator configured to maintain liquid for freezing into solid. The apparatus further includes a first chamber distributed along a first side surface area between a first side of a casing and a first side of an evaporator configured to receive refrigerant from the first inlet means. The first chamber acts as a first heat exchange allowing the refrigerant received from the first inlet means to undergo heat transfer and reduction in temperature due to thermal exchange with the first side of the evaporator. The apparatus further includes a second chamber distributed along second side surface area between a second side of the casing and a second side of the evaporator configured to receive refrigerant from the first chamber. The second chamber acts as a second heat exchange allowing the refrigerant received from the first chamber to undergo heat transfer and reduction in temperature due to thermal exchange with the second side of the evaporator. The apparatus further includes a third chamber existing among a hollow center chamber of the evaporator configured to receive refrigerant from the second chamber.

The third chamber acts as a third heat exchange allowing the refrigerant received from the second chamber to undergo heat transfer and reduction in temperate due to thermal exchange with the evaporator as the refrigerant passes along the hollow center chamber of the evaporator. The apparatus further includes a fourth chamber distributed along a fourth side surface area between a fourth side of the casing and a fourth side of the evaporator configured to receive refrigerant form the third chamber. The fourth chamber acts as a fourth heat exchange allowing the refrigerant received from the third chamber to undergo a heat transfer and reduction in temperature due to thermal exchange with the fourth side of the evaporator. The fourth chamber and the second chamber may be on opposite sides of the evaporator. The apparatus further includes a first outlet means to allow the refrigerant to exit the casing. The apparatus further includes a second inlet means configured to allow the refrigerant to enter the evaporator after exiting the casing and distribute the refrigerant within the evaporator. The apparatus further includes a second outlet means allows the refrigerant to exit the evaporator and cycle through a refrigeration system.

In another inventive aspect, there is an evaporator with dual piped liquid line heat exchange apparatus. The apparatus includes, an evaporator having a plurality of parallel tubes longitudinally disposed within the evaporator configured to maintain liquid for freezing into solid. The apparatus also includes a dual piped liquid line, having an outer pipe first inlet means configured to allow refrigerant into a casing covering the evaporator and an inner pipe second outlet means configured to allows the refrigerant to exit the evaporator and cycle through a refrigeration system. The inner pipe having cold liquid refrigerant and the outer pipe having hot gaseous refrigerant. The outer pipe acts as a fifth heat exchange allowing the refrigerant received from the refrigeration system to undergo heat transfer and reduction in temperate due to thermal exchange with the inner pipe as the refrigerant passes through the dual piped liquid line. The apparatus further includes a first chamber distributed along a first side surface area between a first side of a casing and a first side of an evaporator configured to receive refrigerant from the outer pipe first inlet means. The first chamber acts as a first heat exchange allowing the refrigerant received from the first inlet means to undergo heat transfer and reduction in temperature due to thermal exchange with the first side of the evaporator. The apparatus further includes a second chamber distributed along second side surface area between a second side of the casing and a second side of the evaporator configured to receive refrigerant from the first chamber. The second chamber acts as a second heat exchange allowing the refrigerant received from the first chamber to undergo heat transfer and reduction in temperature due to thermal exchange with the second side of the evaporator. The apparatus further includes a third chamber existing among a hollow center chamber of the evaporator configured to receive refrigerant from the second chamber. The third chamber acts as a third heat exchange allowing the refrigerant received from the second chamber to undergo heat transfer and reduction in temperate due to thermal exchange with the evaporator as the refrigerant passes along the hollow center chamber of the evaporator. The apparatus further includes, a fourth chamber distributed along a fourth side surface area opposite the second chamber between a fourth side of the casing and a fourth side of the evaporator configured to receive refrigerant form the third chamber. The fourth chamber acts as a fourth heat exchange allowing the refrigerant received from the third chamber to undergo a heat transfer and reduction in temperature due to thermal exchange with the fourth side of the evaporator. The apparatus further includes a first outlet means to allow the refrigerant to exit the casing. The apparatus further includes a second inlet means configured to allow the refrigerant to enter the evaporator after exiting the casing and distribute the refrigerant within the evaporator.

In another inventive aspect, there is an evaporator with space reducers and integrated heat exchange apparatus. The apparatus includes a first inlet means to allow refrigerant into a casing covering an evaporator. The apparatus also includes an evaporator having: a plurality of parallel tubes longitudinally disposed within the evaporator configured to maintain liquid for freezing into solid, a plurality of parallel custom shaped solid tubes longitudinally disposed along an interior perimeter of the evaporator; a center custom shaped solid tube longitudinally disposed along the center of the evaporator. The plurality of parallel custom shaped solid tubes longitudinally disposed along an interior perimeter of the evaporator are comprised of metallic substance which does not interact with the refrigerant. The plurality of parallel custom shaped solid tubes longitudinally disposed along an interior perimeter of the evaporator are fitted permanently into position. The center solid tube longitudinally disposed along the center of the evaporator has a hollow center portion. The apparatus further including a first chamber distributed along a first side surface area between a first side of a casing and a first side of an evaporator configured to receive refrigerant from the first inlet means. The first chamber acts as a first heat exchange allowing the refrigerant received from the first inlet means to undergo heat transfer and reduction in temperature due to thermal exchange with the first side of the evaporator. The apparatus further includes a second chamber distributed along second side surface area between a second side of the casing and a second side of the evaporator configured to receive refrigerant from the first chamber. The second chamber acts as a second heat exchange allowing the refrigerant received from the first chamber to undergo heat transfer and reduction in temperature due to thermal exchange with the second side of the evaporator. The evaporator further includes a third chamber distributed along a third surface area opposite the second chamber between a third side of the casing and a third side of the evaporator configured to receive refrigerant from the first chamber. The third chamber acts as a third heat exchange allowing the refrigerant received from the first chamber to undergo a heat transfer and reduction in temperature due to thermal exchange with the third side of the evaporator. The apparatus further includes a first outlet means to allow the refrigerant to exit the casing. The apparatus further includes a second inlet means configured to allow the refrigerant to enter the evaporator after exiting the casing and distribute the refrigerant within the evaporator. The apparatus further includes a second outlet means allows the refrigerant to exit the evaporator and cycle through a refrigeration system.

Neither this summary nor the following detailed description purports to define the invention. The invention is defined by the claims.

BRIEF DESCRIPTION OF THE DRAWINGS

Embodiments of various inventive features will now be described with reference to the following drawings. Throughout the drawings, reference numbers may be reused to indicate correspondence between referenced elements. The drawings are provided to illustrate example embodiments described herein and are not intended to limit the scope of disclosure.

DETAILED DESCRIPTION

Specific embodiments will now be described with reference to the drawings. These embodiments are intended to illustrate and, not limit, the present invention.

Figure 1:
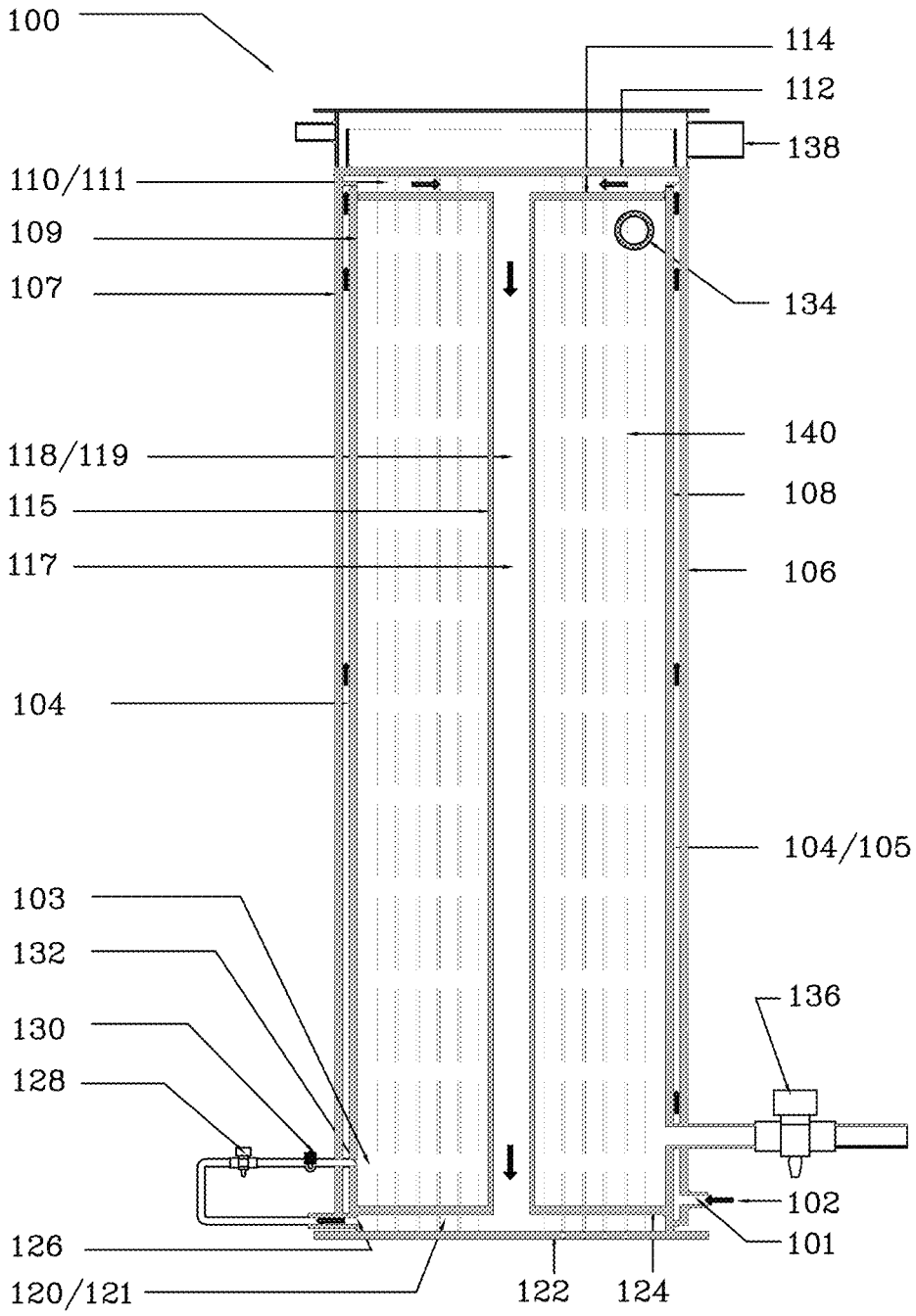
FIG. 1 illustrates a side-view of the evaporator with heat exchange in accordance with one embodiment.

FIG. 1 is an exemplary embodiment of a side-view of the evaporator with heat exchange apparatus. In the illustrated embodiment, the evaporator with heat exchange system 100 is comprised of a plurality of components, including an evaporator 109 and an external casing 107 coving the evaporator from all sides. In one embodiment, the material makeup of the exterior sides of an evaporator 109 may be steel, stainless steel or other metallic (conductive) materials. In one embodiment, the material makeup of the exterior sides of a external casing 107 may be steel, stainless steel, aluminum or other metal compounds. In one embodiment, the evaporator with heat exchange system 100 receives hot refrigerant 101, (i.e. Freon or ammonia), by means of the liquid line 102 whereby the hot refrigerant 101 is directed into a side chamber 104 between the outer perimeter of the side of evaporator 108 and along the inner perimeter of the side of casing 106. When the hot refrigerant 101 is traveling vertically through the side chamber 104 it is simultaneously traveling through the side heat exchange 105 within the evaporator with heat exchange system 100. Wherein the side chamber 104 undergoing a heat exchange allowing the hot refrigerant 101 to undergo a heat transfer and reduction in temperature due to thermal exchange with the side portion of the evaporator 108 which contains cold refrigerant.

Thereafter, the refrigerant 101 travels to a top chamber 110 configured between the outer top side of the evaporator 114 and the inner top side of the casing 112. When the refrigerant 101 travels through the top chamber 110 it is simultaneously traveling through the top heat exchange 111 within the evaporator with heat exchange system 100. The top chamber 110 is undergoing a heat exchange allowing the hot refrigerant 101 to undergo a heat transfer and reduction in temperature due to thermal exchange with the top side of the evaporator 114 which contains cold refrigerant.

Thereafter, the refrigerant 101 travels through the hollow center chamber 118 configured between the exterior center wall of evaporator 115 and interior center cavity of the casing 117. When the refrigerant 101 travels through the center chamber 118 it is simultaneously traveling through the center heat exchange 119 within the evaporator with heat exchange system 100. Wherein the center chamber 118 is undergoing a heat exchange allowing the hot refrigerant 101 to undergo a heat transfer and reduction in temperature due to the thermal exchange with exterior center wall of the evaporator 115 which contains cold refrigerant.

Thereafter, the refrigerant 101 travels through the bottom chamber 120 configured between the exterior bottom side of the evaporator 124 and interior bottom side of the casing 122. When the refrigerant 101 travels through the bottom chamber 120 it is simultaneously traveling through the bottom heat exchange 121 within the evaporator with heat exchange system 100. The bottom chamber 120 is undergoing a heat exchange allowing the hot refrigerant 101 to undergo a heat transfer and reduction in temperature due to the thermal exchange with the bottom side of the evaporator 124 which contains cold refrigerant.

Thereafter, the refrigerant 101 exits the bottom chamber 120 by an outlet means 126 and travels towards the liquid feed solenoid valve 128 which controls the refrigerant 101 feed into the evaporator and allows the evaporator 109 to freeze in order to produce freeze/ice within the evaporator 109. The refrigerant 101 then bypasses the gas adjustable valve 130 (also known as "expansion valve") where the refrigerant is pressurized and forced into the chamber room of the evaporator through a opening and enters the evaporator by an inlet means 132 wherein the refrigerant 101 will be substantially changed in form to a cold refrigerant 103 within the evaporator 109 due to colder temperatures within the evaporator 109. The cold refrigerant 103 within the evaporator 109 will travel vertically up in between a plurality of parallel tubes 140 longitudinally disposed within the evaporator 109 configured to maintain liquid for freezing into solid and will continue to circulate within the evaporator 109 until the refrigerant exits the evaporator 109 by means of an suction line 134 which permits the refrigerant to leave the evaporator 109 and casing 107 and be transmitted towards the compressor (not shown) where it is pressurized and cycles through the refrigeration system. The evaporator with heat exchange system 100 may be connected to or comprise a hot gas solenoid valve 136. In one embodiment, the hot gas solenoid valve 136 acts as a defrost mechanism to release ice whereby the hot gas warms the evaporator 107 permitting ice to be released and harvested. The evaporator with heat exchange system 100 may be connected to or comprise a liquid inlet 138 configured above the evaporator with heat exchange system 100 to permit liquid to be inserted into the tubes 140 within the evaporator 109.

Alternative embodiments are also disclosed whereby the refrigerant enters the evaporator with heat exchange system 100 at the top and travels in the opposite directions as depicted and described in FIG. 1.

Figure 2:
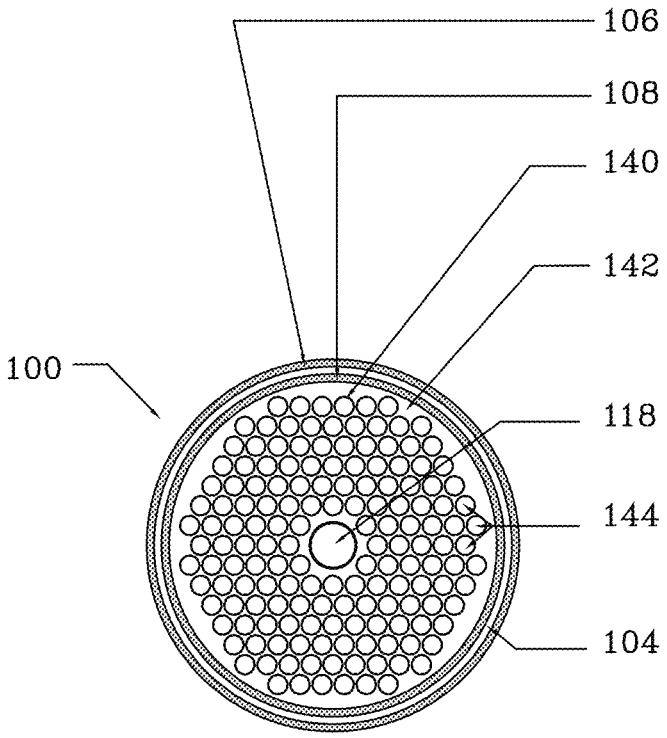
FIG. 2 illustrates a mid-view of the evaporator with heat exchange in accordance with one embodiment.

FIG. 2 is an exemplary embodiment of a mid-view of the evaporator with heat exchange system 100. The inner most portion comprises the center chamber 118 whereby the refrigerant 101 travels downward (optionally, upward) while circulating in between the casing 107 and the evaporator 109 as described in FIG. 1. The exterior of the evaporator 109 is surrounded by a side chamber 104 comprised of a cavity between the side of the casing 106 and the side of the evaporator 108. The evaporator's inside is comprised of a plurality of tubes 140 aligned vertically containing liquid through 144 and surrounded by liquid freezing area 142 where cold refrigerant 103 travels. In one embodiment, the tubes 140 may be made of stainless steel (or other metal) and contain liquid and are between 6 inches and twenty-five feet tall or taller.

Figure 3:
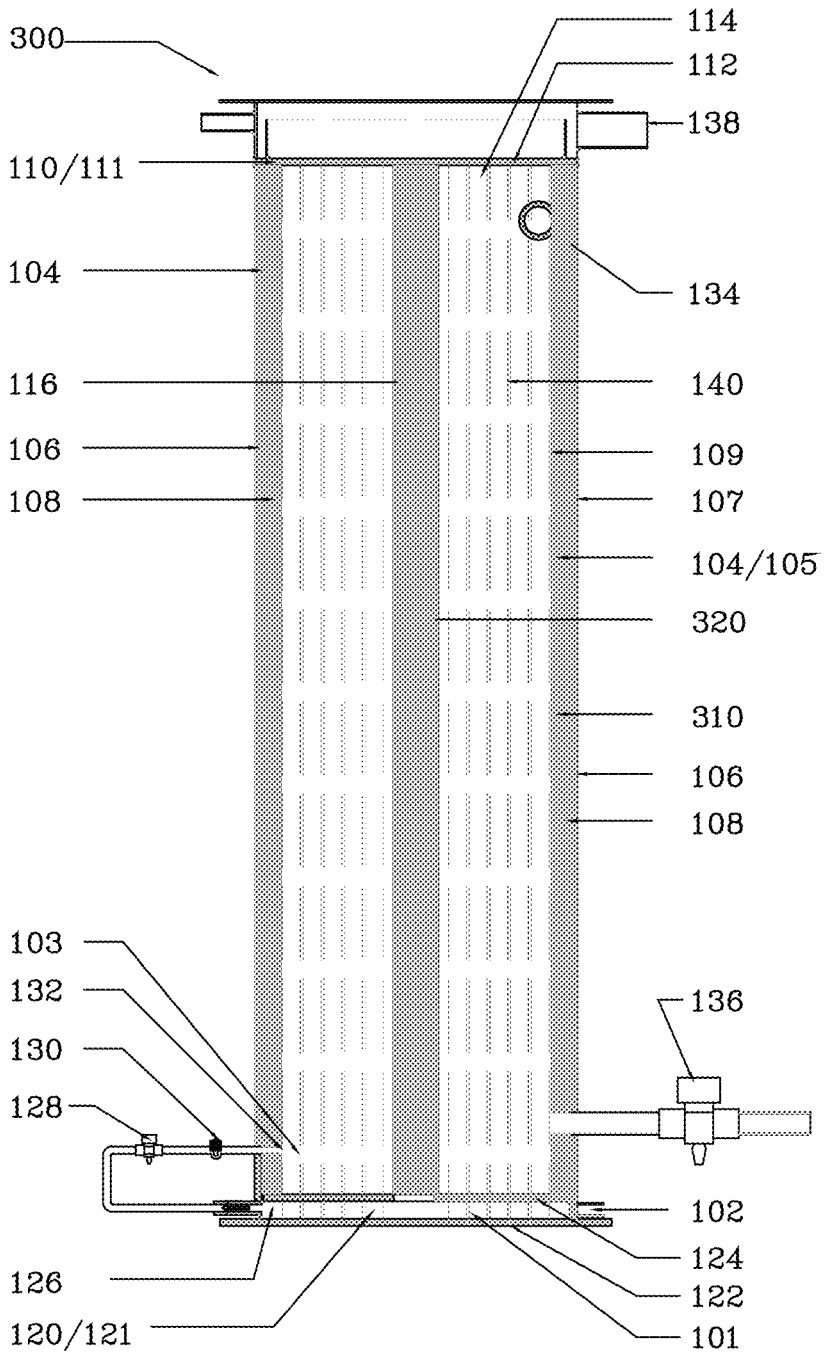
FIG. 3 illustrates a side-view of the evaporator with space reducer and heat exchange in accordance with one embodiment.

FIG. 3 is an exemplary embodiment of a side-view of the evaporator with integrated space reducers and heat exchange apparatus. In the illustrated embodiment, the evaporator with integrated space reducers and heat exchange system 300 is comprised of a plurality of components, including an evaporator 109 and an external casing 107 coving the evaporator from all sides. In one embodiment, the material makeup of the exterior sides of an evaporator may be steel, stainless steel or other metallic (conductive) materials. In one embodiment, the evaporator with integrated space reducers and heat exchange system 300 receives hot refrigerant 101, (i.e. Freon or ammonia), by means of the liquid line 102 whereby the hot refrigerant 101 is directed into a side chamber 104 between the outer perimeter of the side of evaporator 108 and along the inner perimeter of the side of casing 106. When the refrigerant 101 is traveling vertically through the side chamber 104 it is simultaneously traveling through the side heat exchange 105 within the evaporator with integrated space reducers and heat exchange system 300. Wherein the side chamber 104 undergoing a heat exchange allowing the hot refrigerant to undergo a heat transfer and reduction in temperature due to thermal exchange with the side portion of the evaporator 108 which contains cold refrigerant.

Thereafter, the refrigerant 101 travels through the bottom chamber 120 configured between the exterior bottom side of the evaporator 124 and interior bottom side of the casing 122. When the refrigerant 101 travels through the bottom chamber 120 it is simultaneously traveling through the bottom heat exchange 121 within the evaporator with integrated space reducers and heat exchange system 300. Wherein the bottom chamber 120 is undergoing a heat exchange allowing the hot refrigerant 101 to undergo a heat transfer and reduction in temperature due to the thermal exchange with the bottom side of the evaporator 124 which contains cold refrigerant.

Thereafter, the refrigerant 101 exits the bottom chamber 120 by an outlet means 126 and travels towards the liquid feed solenoid valve 128 which controls the refrigerant 101 feed into the evaporator and allows the evaporator 109 to freeze in order to produce freeze/ice within the evaporator 109. The refrigerant 101 then bypasses the gas adjustable valve 130 (also known as "expansion valve") where the refrigerant is pressurized and forced into the chamber room of the evaporator through a opening and enters the evaporator by an inlet means 132 wherein the refrigerant 101 will be substantially changed in form to a cold refrigerant 103 within the evaporator 109 due to colder temperatures within the evaporator 109. The cold refrigerant 103 within the evaporator 109 will travel vertically up in between a plurality of parallel tubes 140 longitudinally disposed within the evaporator 109 configured to maintain liquid for freezing into solid. The inside of the evaporator 109 will comprise a plurality of perimeter space reducers 310 and may contain at least one center space reducer 320. In one embodiment, the perimeter space reducers 310 and/or the center space reducer 320 may be permanently adhered into position within the evaporator. Perimeter space reducers 310 and central space reducers 320 reduce the cubic space within the evaporator in order to increase the cooling efficiency of the evaporator. When the evaporator is smaller, in cubic size, the refrigerant is able cool the water much quicker resulting in faster ice production as compared to an evaporator of larger size with un-used (open and spacious) portions. The center space reducer 320 may be comprised of a variety of materials such as steel or other metallic compounds, plastic, or glass. The cold refrigerant 103 will continue to circulate within the evaporator 109 until the refrigerant exits the evaporator 109 by means of a suction line 134 which permits the refrigerant to leave the evaporator 109 and casing 107 and be transmitted towards the compressor (not shown) where it is pressurized and cycles through the refrigeration system. The evaporator with integrated space reducers and heat exchange system 300 may be connected to or comprise a hot gas solenoid valve 136. In one embodiment, the hot gas solenoid valve 136 acts as a defrost mechanism to release ice whereby the hot gas warms the evaporator 107 permitting ice to be released and harvested. The evaporator with integrated space reducers and heat exchange system 300 may be connected to or comprise a liquid inlet 138 configured above the evaporator with integrated space reducers and heat exchange system 300 to permit liquid to be inserted into the tubes 140 within the evaporator 109.

In an alternative embodiment of FIG. 3. the evaporator with integrated space reducers and heat exchange 300 comprises utilizing all three side chambers as well as a center chamber to facilitate heat transfer between the refrigerant 101 within the casing and the evaporator 109. In one embodiment, the evaporator with integrated space reducers and heat exchange system 300 receives hot refrigerant 101, (i.e. Freon or ammonia), by means of the liquid line 102 whereby the hot refrigerant 101 is directed into a side chamber 104 between the outer perimeter of the side of evaporator 108 and along the inner perimeter of the side of casing 106. When the refrigerant 101 is traveling vertically through the side chamber 104 it is simultaneously traveling through the side heat exchange 105 within the evaporator with integrated space reducers and heat exchange system 300. Wherein the side chamber 104 undergoing a heat exchange allowing the hot refrigerant to undergo a heat transfer and reduction in temperature due to thermal exchange with the side portion of the evaporator 108 which contains cold refrigerant.

Thereafter, the refrigerant 101 travels to a top chamber 110 configured between the outer top side of the evaporator 114 and the inner top side of the casing 112. When the refrigerant 101 travels through the top chamber 110 it is simultaneously traveling through the top heat exchange 111 within the evaporator with integrated space reducers with heat exchange system 300. Wherein the top chamber 110 is undergoing a heat exchange allowing the hot refrigerant 101 to undergo a heat transfer and reduction in temperature due to thermal exchange with the top side of the evaporator 114 which contains cold refrigerant.

Thereafter, the refrigerant 101 travels through a center chamber 118 configured through the center of a center space reducer 320 (shown in FIG. 4B) wherein the center space reducer is located between the exterior center wall of evaporator 115 and interior center cavity of the casing 117. In one embodiment, the center space reducer 320 may be comprised of a solid tube with a hollow center portion. In an alternative embodiment, the center space reducer 320 may be comprised of a hollow cylindrical tube with a hollow center portion. When the refrigerant 101 travels through the center chamber 118 it is simultaneously traveling through the center heat exchange 119 within the evaporator with integrated space reducers and heat exchange system 300. Wherein the center chamber 118 is undergoing a heat exchange allowing the hot refrigerant 101 to undergo a heat transfer and reduction in temperature due to the thermal exchange with exterior center wall of the evaporator 115 which contains cold refrigerant.

Thereafter, the refrigerant 101 travels through the bottom chamber 120 configured between the exterior bottom side of the evaporator 124 and interior bottom side of the casing 122. When the refrigerant 101 travels through the bottom chamber 120 it is simultaneously traveling through the bottom heat exchange 121 within the evaporator with integrated space reducers and heat exchange system 300. Wherein the bottom chamber 120 is undergoing a heat exchange allowing the hot refrigerant 101 to undergo a heat transfer and reduction in temperature due to the thermal exchange with the bottom side of the evaporator 124 which contains cold refrigerant.

Thereafter, the refrigerant 101 exits the bottom chamber 120 by an outlet means 126 and travels towards the liquid feed solenoid valve 128 which controls the refrigerant 101 feed into the evaporator and allows the evaporator 109 to freeze in order to produce freeze/ice within the evaporator 109. The refrigerant 101 then bypasses the gas adjustable valve 130 (also known as "expansion valve") where the refrigerant is pressurized and forced into the chamber room of the evaporator through a opening and enters the evaporator by an inlet means 132 wherein the refrigerant 101 will be substantially changed in form to a cold refrigerant 103 within the evaporator 109 due to colder temperatures within the evaporator 109. The cold refrigerant 103 within the evaporator 109 will travel vertically up in between a plurality of parallel tubes 140 longitudinally disposed within the evaporator 109 configured to maintain liquid for freezing into solid. The inside of the evaporator 109 will comprise a plurality of perimeter space reducers 310 and may contain at least one center space reducer 320. Perimeter space reducers 310 and central space reducers 320 reduce the cubic space within the evaporator in order to increase the cooling efficiency of the evaporator. When the evaporator is smaller, in cubic size, the refrigerant is able cool the water much quicker resulting in faster ice production as compared to an evaporator of larger size with un-used (open and spacious) portions. The center space reducer 320 may be comprised of a variety of materials such as steel or other metallic compounds, plastic, or glass.

The refrigerant will continue to circulate within the evaporator 109 until the refrigerant exits the evaporator 109 by means of a suction line 134 which permits the refrigerant to leave the evaporator 109 and casing 107 and be transmitted towards the compressor (not shown) where it is pressurized and cycles through the refrigeration system. The evaporator with integrated space reducers with heat exchange system 300 may be connected to or comprise a hot gas solenoid valve 136. In one embodiment, the hot gas solenoid valve 136 acts as a defrost mechanism to release ice whereby the hot gas warms the evaporator 107 permitting ice to be released and harvested. The evaporator with integrated space reducers and heat exchange system 300 may be connected to or comprise a liquid inlet 138 configured above the evaporator with integrated space reducers and heat exchange system 300 to permit liquid to be inserted into the tubes 140 within the evaporator 109.

Alternative embodiments are also disclosed whereby the refrigerant enters the evaporator with integrated space reducers and heat exchange system 300 at the top and travels in the opposite directions as depicted and described in FIG. 3.

Figure 4A:
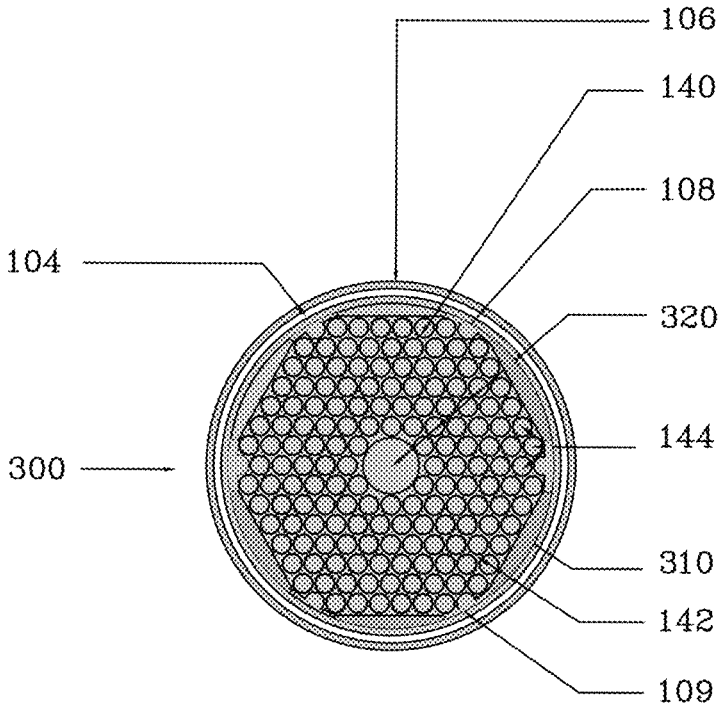
FIG. 4A illustrates a mid-view of the evaporator with space reducer and heat exchange in accordance with one embodiment.
Figure 4B:
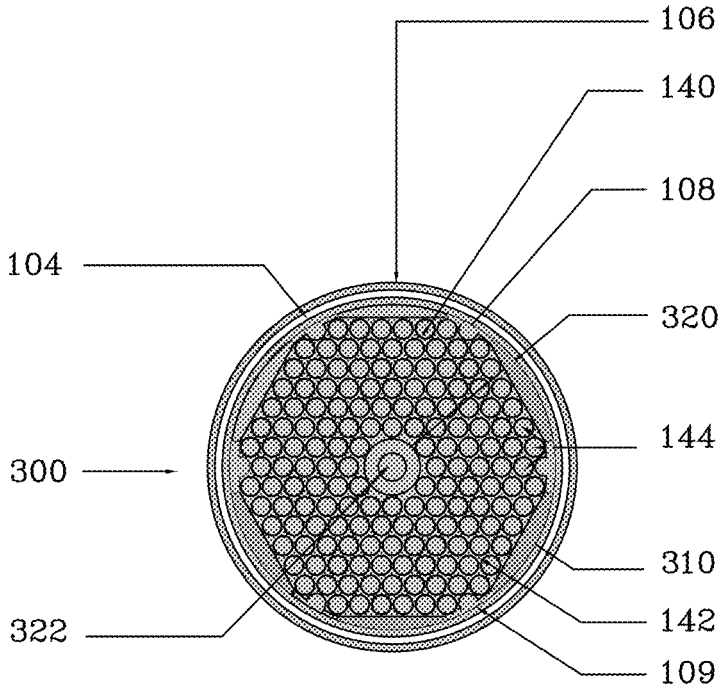
FIG. 4B illustrates a mid-view of the evaporator with space reducer and heat exchange in accordance with one embodiment.

FIG. 4A is an exemplary embodiment of a mid-view of the evaporator integrated space reducers with heat exchange system 300. The inner most portion comprises the center space reducer 320 as a means to reduce the cubic space within the evaporator in order to increase the cooling efficiency of the evaporator. When the evaporator is smaller, in cubic size, the refrigerant is able cool the water much quicker resulting in faster ice production as compared to an evaporator of larger size with un-used (open and spacious) portions. The center space reducer 320 may be of custom shape and may be comprised of a variety of materials such as steel or other metallic compounds, plastic, or glass. In one embodiment, the center space reducer 320 is comprised of stainless steel surrounding a rounded evaporator, as shown in FIG. 3, FIG. 4A, and FIG. 4B. The perimeter space reducer 310 may be comprised of a variety of materials such as steel or other metallic compounds, plastic, or glass. In one embodiment, the perimeter space reducer 310 may be made of a custom shape comprised of metallic material which does not interact with the refrigerant. The exterior of the evaporator 109 is surrounded by a side chamber 104 comprised of a cavity between the side of the casing 106 and the side of the evaporator 108. The evaporator's inside is comprised of a plurality of tubes 140 aligned vertically containing liquid through 144 and surrounded by liquid freezing area 142 where cold refrigerant 103 travels. In one embodiment, the tubes 140 may be made of stainless steel (or other metal) and contain liquid and are between 6 inches and twenty-five feet tall or taller. Along the interior perimeter of the evaporator 109 are a plurality of perimeter space reducers 310 used as a means to reduce the cubic space within the evaporator in order to increase the cooling efficiency of the evaporator. When the evaporator is smaller, in cubic size, the refrigerant is able cool the water much quicker resulting in faster ice production as compared to an evaporator of larger size with un-used (open and spacious) portions. The perimeter space reducer 310 may be comprised of a variety of materials such as steel or other metallic compounds, plastic, or glass. In one embodiment, the perimeter space reducer 310 may be made of a custom shape comprised of metallic material which does not interact with the refrigerant, as shown in FIG. 3, FIG. 4A, and FIG. 4B.

FIG. 4B is an exemplary embodiment of a mid-view of the evaporator with integrated space reducers and heat exchange system 300. The inner most portion comprises the center space reducer 320 as a means to reduce the cubic space within the evaporator in order to increase the cooling efficiency of the evaporator. When the evaporator is smaller, in cubic size, the refrigerant is able cool the water much quicker resulting in faster ice production as compared to an evaporator of larger size with un-used (open and spacious) portions. The center space reducer 320 may have a hollow center cavity within the space reducer 322 to allow refrigerant 101 within the casing to travel to another chamber around the exterior of the evaporator 109. The center space reducer 320 may be of a custom shape and may comprise variety of materials such as steel or other metallic compounds, plastic, or glass. In one embodiment, the center space reducer 320 is comprised of stainless steel surrounding a rounded evaporator, as shown in FIG. 3, FIG. 4A, and FIG. 4B. The perimeter space reducer 310 may be comprised of a variety of materials such as steel or other metallic compounds, plastic, or glass. In one embodiment, the perimeter space reducer 310 may be made of a custom shape comprised of metallic material which does not interact with the refrigerant. The exterior of the evaporator 109 is surrounded by a side chamber 104 comprised of a cavity between the side of the casing 106 and the side of the evaporator 108. The evaporator's inside is comprised of a plurality of tubes 140 aligned vertically containing liquid through 144 and surrounded by liquid freezing area 142 where cold refrigerant 103 travels. In one embodiment, the tubes 140 may be made of stainless steel (or other metal) and contain liquid and are between 6 inches and twenty-five feet tall or taller. Along the interior perimeter of the evaporator 109 are a plurality of perimeter space reducers 310 used as a means to reduce the cubic space within the evaporator in order to increase the cooling efficiency of the evaporator. When the evaporator is smaller, in cubic size, the refrigerant is able cool the water much quicker resulting in faster ice production as compared to an evaporator of larger size with un-used (open and spacious) portions. The perimeter space reducer 310 may be comprised of a variety of materials such as steel or other metallic compounds, plastic, or glass. In one embodiment, the perimeter space reducer 310 may be made of a custom shape comprised of metallic material which does not interact with the refrigerant, as shown in FIG. 3, FIG. 4A, and FIG. 4B.

Figure 5:
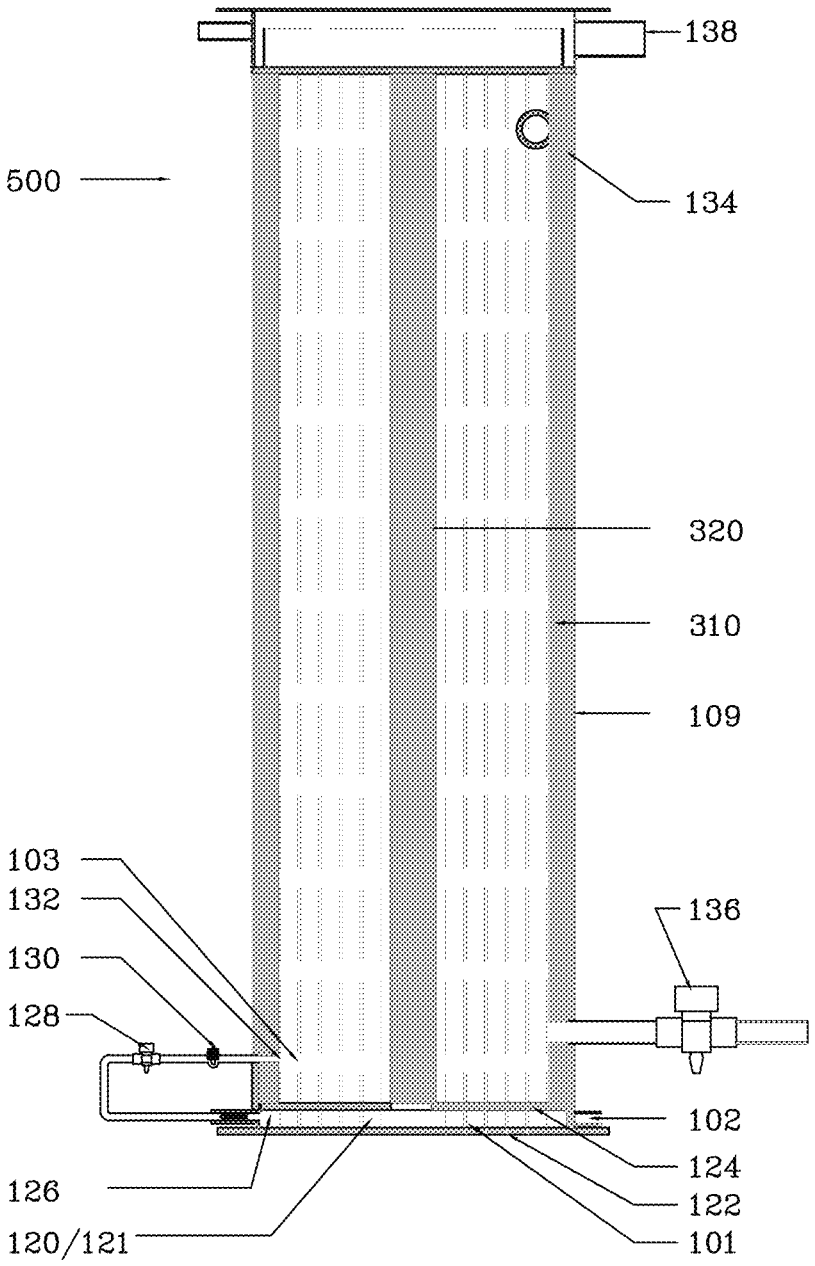
FIG. 5 illustrates a side-view of the evaporator with space reducer in accordance with one embodiment.

FIG. 5 is an exemplary embodiment of a side-view of the evaporator with space reducer apparatus. In one embodiment, the material makeup of the exterior sides of an evaporator may be steel, stainless steel or other metallic (conductive) materials. In one embodiment, the evaporator with space reducer system 500 receives refrigerant 101, (i.e. Freon or ammonia), by means of the liquid line 110 whereby the refrigerant travels through a bottom chamber 120 between the exterior bottom side of the evaporator 124 and the interior bottom side of casing 122, as shown in FIG. 5, but may be along the top side of the evaporator depending on the design of the evaporator. The refrigerant exits the bottom chamber 120 by means of an outlet 126 along the bottom of the evaporator and travels to the liquid feed solenoid valve 128 then through the gas adjustable valve 130 (also known as "expansion valve") where the refrigerant is pressurized and forced into the chamber room of the evaporator through a opening. When the refrigerant 101 enters the evaporator 109 by means of an inlet 132 it changes into a cold refrigerant 103 which enters the chamber room in the evaporator comprising a plurality of perimeter space reducers configured along the inner perimeter of the evaporator and an optional center space reducer, along with plurality of tubes where liquid is stored for freezing will begin to cool as a result of the cold refrigerant and begins to freeze the contents of the steel tubes. After a configurable set of time, when the cold refrigerant will exit the chamber room of the evaporator by means of the outlet means 134. Moreover, the evaporator with space reducer system 500 may be connected to or comprise a water inlet 138 configured above the evaporator with space reducer system 500. Alternative embodiments are also disclosed whereby the refrigerant enters the evaporator with space reducer system 500 at the top or middle portions of the evaporator depending on where the liquid line 110 and gas adjustable valve 160 are configured.

Figure 6:
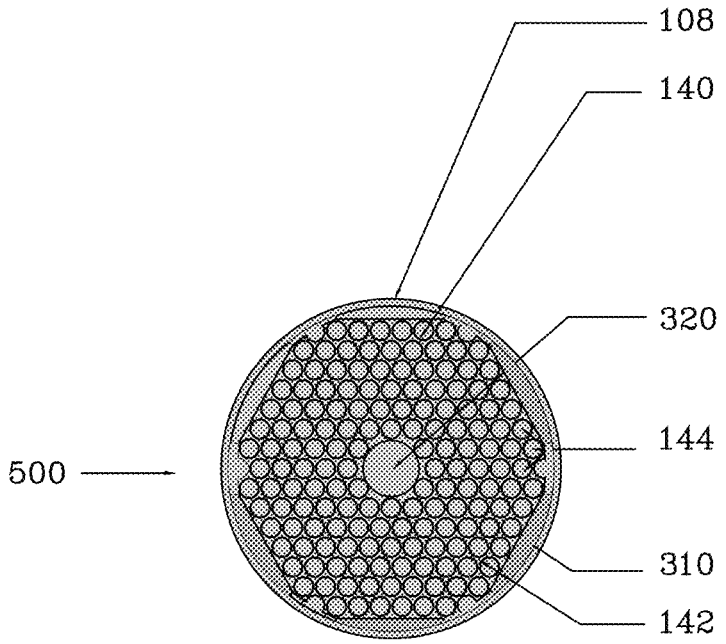
FIG. 6 illustrates a mid-view of the evaporator with space reducer in accordance with one embodiment.

FIG. 6 is an exemplary embodiment of a mid-view of the evaporator with space reducer. The center portion of the evaporator with space reducer 500 is comprised of a plurality of tubes 140 aligned vertically containing water through 144 and surrounded by liquid freezing area 142 where the refrigerant 103 is maintained within the evaporator. In one embodiment, the tubes 140 contain water and are between 6 inches and twenty-five feet tall or taller. Along the side of the evaporator 108 and around the interior perimeter of the evaporator with space reducer system 500 are a plurality of perimeter space reducer 310. In another embodiment, the perimeter space reducers 310 are comprised of steel (to be more conductive and allow cool to spread) surrounding a square, rectangular, or cylindrical shaped evaporator that permits refrigerant to travel around its perimeter in order to freeze water into ice. In another embodiment, the hollow center exterior portion of the evaporator may be fitted with a center space reducer 320. The space reducers act as a means to reduce the cubic space within the evaporator in order to increase the cooling efficiency of the evaporator. When the evaporator is smaller, in cubic size, the refrigerant is able cool the water much quicker resulting in faster ice production as compared to an evaporator of larger size with un-used (open and spacious) portions. The space reducers may be comprised of a variety of materials such as steel or other metallic compounds, plastic, or glass.

Figure 7:
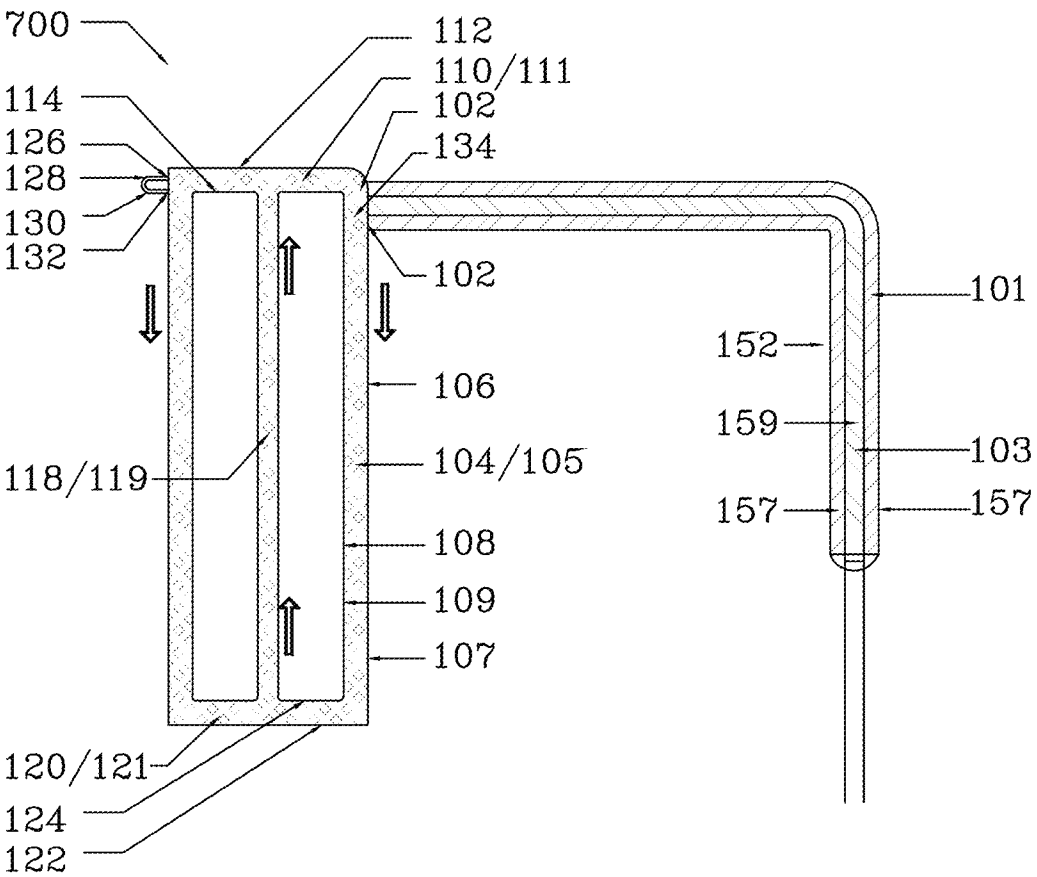
FIG. 7 illustrates a side-view of the evaporator with dual pipe heat exchange in accordance with one embodiment.

FIG. 7 is an exemplary embodiment of a side-view of the evaporator with dual-pipe heat exchange apparatus. In the illustrated embodiment, the evaporator with dual-pipe heat exchange system 700 is comprised of a plurality of components, including an evaporator 109, a dual pipe tube 156, and an external casing 107 coving the evaporator from all sides. In one embodiment, dual pipe tube 156 is configured to transport hot refrigerant 101 through the outer pipe 157 through a liquid line 102 into a side chamber 104. In addition, the dual pipe tube 156 is configured to transport cold refrigerant 103 through the inner tube 159 from the suction line 134 into the compressor (not shown) to cycle through a refrigeration system (not shown). While the hot refrigerant 101 and the cold refrigerant 103 are simultaneously passing in opposite direction within the dual pipe tube 156, the outer pipe 157 may be acting as a heat exchange allowing the hot refrigerant 101 received from the refrigeration system (not shown) intended for the side chamber 104 to undergo heat transfer and reduction in temperature due to thermal exchange with the inner pipe 159 as the hot refrigerant 101 passes through the dual pipe 156. In one embodiment, the material makeup of the exterior sides of an evaporator may be steel, stainless steel or other metallic (conductive) materials. In one embodiment, the evaporator with dual pipe heat exchange system 700 receives hot refrigerant 101, (i.e. Freon or ammonia), by means of the liquid line 102 whereby the hot refrigerant 101 is directed into a side chamber 104 between the outer perimeter of the side of evaporator 108 and along the inner perimeter of the side of casing 106. When the hot refrigerant 101 is traveling vertically downward through the side chamber 104 it is simultaneously traveling through the side heat exchange 105 within the evaporator with dual-pipe heat exchange system 700. Wherein the side chamber 104 undergoing a heat exchange allowing the hot refrigerant 101 to undergo a heat transfer and reduction in temperature due to thermal exchange with the side portion of the evaporator 108 which contains cold refrigerant.

Thereafter, the refrigerant 101 travels to a bottom chamber 120 configured between the outer bottom side of the evaporator 124 and the inner bottom side of the casing 122. When the refrigerant 101 travels through the bottom chamber 120 it is simultaneously traveling through the bottom heat exchange 121 within the evaporator with dual-pipe heat exchange system 700. Wherein the bottom chamber 120 is undergoing a heat exchange allowing the hot refrigerant 101 to undergo a heat transfer and reduction in temperature due to thermal exchange with the bottom side of the evaporator 124 which contains cold refrigerant.

Thereafter, the refrigerant 101 travels through the hollow center chamber 118 configured between the exterior center wall of evaporator 115 and interior center cavity of the casing 117. When the refrigerant 101 travels through the center chamber 118 it is simultaneously traveling through the center heat exchange 119 within the evaporator with dual-pipe heat exchange system 700. Wherein the center chamber 118 is undergoing a heat exchange allowing the hot refrigerant 101 to undergo a heat transfer and reduction in temperature due to the thermal exchange with exterior center wall of the evaporator 115 which contains cold refrigerant.

Thereafter, the refrigerant 101 travels through the top chamber 110 configured between the exterior top side of the evaporator 114 and interior top side of the casing 112. When the refrigerant 101 travels through the top chamber 110 it is simultaneously traveling through the top heat exchange 111 within the evaporator with dual-pipe heat exchange system 700. Wherein the top chamber 110 is undergoing a heat exchange allowing the hot refrigerant 101 to undergo a heat transfer and reduction in temperature due to the thermal exchange with the top side of the evaporator 114 which contains cold refrigerant.

Thereafter, the refrigerant 101 exits the top chamber 110 by an outlet means 126 and travels towards the liquid feed solenoid valve 128 which controls the refrigerant 101 feed into the evaporator and allows the evaporator 109 to freeze in order to produce freeze/ice within the evaporator 109. The refrigerant 101 then bypasses the gas adjustable valve 130 (also known as "expansion valve") where the refrigerant is pressurized and forced into the chamber room of the evaporator through a opening and enters the evaporator by an inlet means 132 wherein the refrigerant 101 will be substantially changed in form to a cold refrigerant 103 within the evaporator 109 due to change in pressure and colder temperatures within the evaporator 109. The cold refrigerant 103 within the evaporator 109 will travel in between a plurality of parallel tubes 140 longitudinally disposed within the evaporator 109 configured to maintain liquid for freezing into solid and will continue to circulate within the evaporator 109 until the refrigerant exits the evaporator 109 by means of an suction line 134 which permits the refrigerant 103 to leave the evaporator 109 and casing 107 and be transmitted towards the compressor (not shown) where it is pressurized and cycles through the refrigeration system. The evaporator with dual-pipe heat exchange system 700 may be connected to or comprise a liquid inlet (not shown) configured above the evaporator 109 to permit liquid to be inserted into the tubes 140 within the evaporator 109.

Alternative embodiments are also disclosed whereby the refrigerant enters the evaporator with dual-pipe heat exchange system 700 at the bottom and travels in the opposite directions as depicted and described in FIG. 7.

Figure 8:
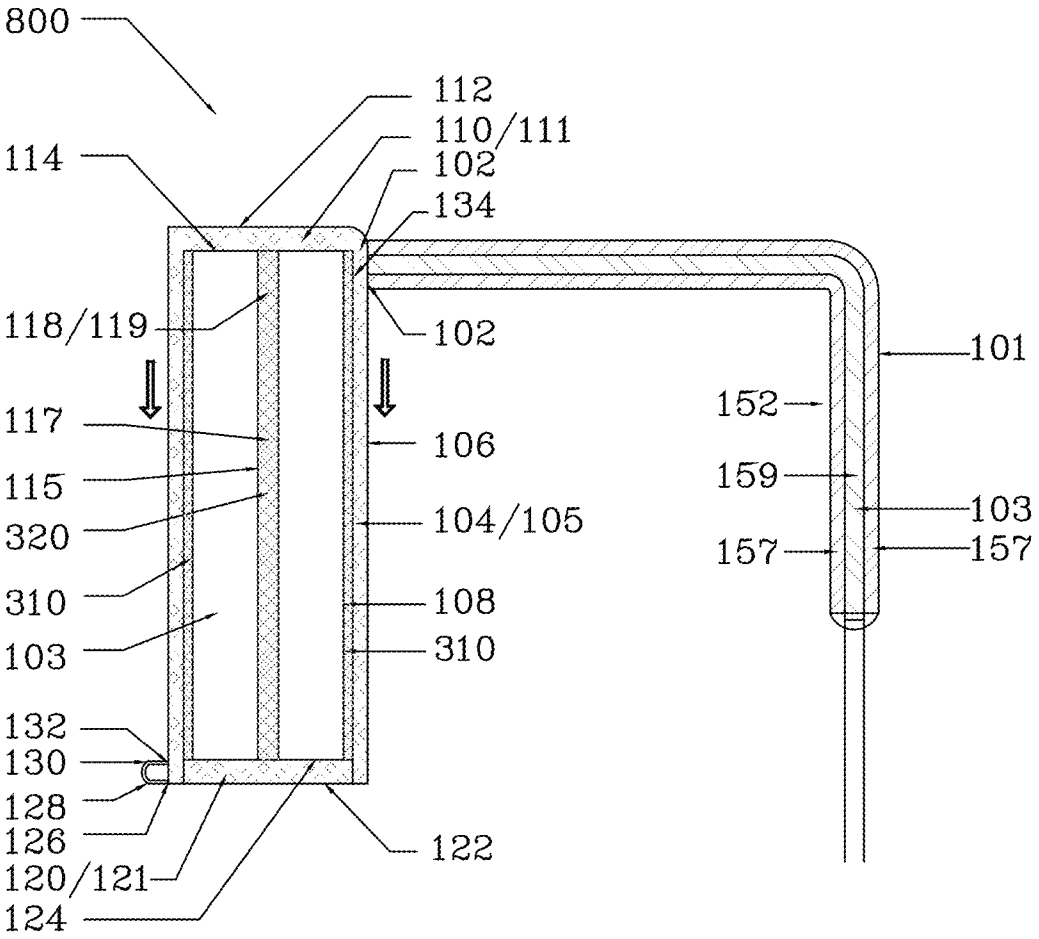
FIG. 8 illustrates a side-view of the evaporator with space reducer and dual pipe heat exchange in accordance with one embodiment.

FIG. 8 is an exemplary embodiment of a side-view of the evaporator with space reducers and dual-pipe heat exchange apparatus. In the illustrated embodiment, the evaporator with space reducers and dual-pipe heat exchange system 800 is comprised of a plurality of components, including an evaporator 109, a dual pipe tube 156, and an external casing 107 coving the evaporator from all sides. In one embodiment, dual pipe tube 156 is configured to transport hot refrigerant 101 through the outer pipe 157 through a liquid line 102 into a side chamber 104 between the outer perimeter of the side of evaporator 108 and along the inner perimeter of the side of casing 106. When the refrigerant 101 is traveling vertically downward through the side chamber 104 it is simultaneously traveling through the side heat exchange 105 within the evaporator with integrated space reducers and dual-pipe heat exchange system 800. The side chamber 104 may undergoing a heat exchange allowing the hot refrigerant to undergo a heat transfer and reduction in temperature due to thermal exchange with the side portion of the evaporator 108 which contains cold refrigerant. In one embodiment, the material makeup of the exterior sides of an evaporator may be steel, stainless steel or other metallic (conductive) materials.

Thereafter, the refrigerant 101 travels to a bottom chamber 120 configured between the outer bottom side of the evaporator 124 and the inner bottom side of the casing 122. When the refrigerant 101 travels through the bottom chamber 120 it is simultaneously traveling through the bottom heat exchange 121 within the evaporator with integrated space reducers with dual-pipe heat exchange system 800. Wherein the bottom chamber 120 is undergoing a heat exchange allowing the hot refrigerant 101 to undergo a heat transfer and reduction in temperature due to thermal exchange with the bottom side of the evaporator 124 which contains cold refrigerant.

Thereafter, the refrigerant 101 travels through a center chamber 118 configured through the center of a center space reducer 320 (shown in FIG. 4B) wherein the center space reducer is located between the exterior center wall of evaporator 115 and interior center cavity of the casing 117. In one embodiment, the center space reducer 320 may be comprised of a solid tube with a hollow center portion. In an alternative embodiment, the center space reducer 320 may be comprised of a hollow cylindrical tube with a hollow center portion. When the refrigerant 101 travels through the center chamber 118 it is simultaneously traveling through the center heat exchange 119 within the evaporator with integrated space reducers and dual-pipe heat exchange system 800. Wherein the center chamber 118 is undergoing a heat exchange allowing the hot refrigerant 101 to undergo a heat transfer and reduction in temperature due to the thermal exchange with exterior center wall of the evaporator 115 which contains cold refrigerant. In one embodiment, the center space reducer 320 is solid and does not permit refrigerant to travel through the center cavity 117.

Thereafter, the refrigerant 101 travels through the top chamber 110 configured between the exterior top side of the evaporator 114 and interior top side of the casing 112. When the refrigerant 101 travels through the top chamber 110 it is simultaneously traveling through the top heat exchange 111 within the evaporator with integrated space reducers and dual-pipe heat exchange system 800. Wherein the top chamber 110 is undergoing a heat exchange allowing the hot refrigerant 101 to undergo a heat transfer and reduction in temperature due to the thermal exchange with the bottom side of the evaporator 114 which contains cold refrigerant.

Thereafter, the refrigerant 101 exits the casing 107 by an outlet means 126 and travels towards the liquid feed solenoid valve 128 which controls the refrigerant 101 feed into the evaporator and allows the evaporator 109 to freeze in order to produce freeze/ice within the evaporator 109. The refrigerant 101 then bypasses the gas adjustable valve 130 (also known as "expansion valve") where the refrigerant is pressurized and forced into the chamber room of the evaporator through a opening and enters the evaporator by an inlet means 132 wherein the refrigerant 101 will be substantially changed in form to a cold refrigerant 103 within the evaporator 109 due to change in pressure and colder temperatures within the evaporator 109. The cold refrigerant 103 within the evaporator 109 will travel vertically up in between a plurality of parallel tubes 140 longitudinally disposed within the evaporator 109 configured to maintain liquid for freezing into solid. The inside of the evaporator 109 will comprise a plurality of perimeter space reducers 310 and a center space reducer 320. The cold refrigerant 103 will continue to circulate within the evaporator 109 until the cold refrigerant 103 exits the evaporator 109 by means of an suction line 134 which permits the refrigerant to leave the evaporator 109 and casing 107 and be transmitted towards the compressor (not shown) where it is pressurized and cycles through the refrigeration system. The dual pipe tube 156 is configured to transport cold refrigerant 103 through the inner tube 159 from the suction line 134 into the compressor (not shown) to cycle through a refrigeration system (not shown). While the hot refrigerant 101 and the cold refrigerant 103 are simultaneously passing in opposite direction within the dual pipe tube 156, the outer pipe 157 may be acting as a heat exchange allowing the hot refrigerant 101 received from the refrigeration system (not shown) intended for the side chamber 104 to undergo heat transfer and reduction in temperature due to thermal exchange with the inner pipe 159 as the hot refrigerant 101 passes through the dual pipe 156.

Alternative embodiments are also disclosed whereby the refrigerant enters the evaporator with integrated space reducers and dual-pipe heat exchange system 800 at the bottom and travels in the opposite directions as depicted and described in FIG. 8.

Figure 9:
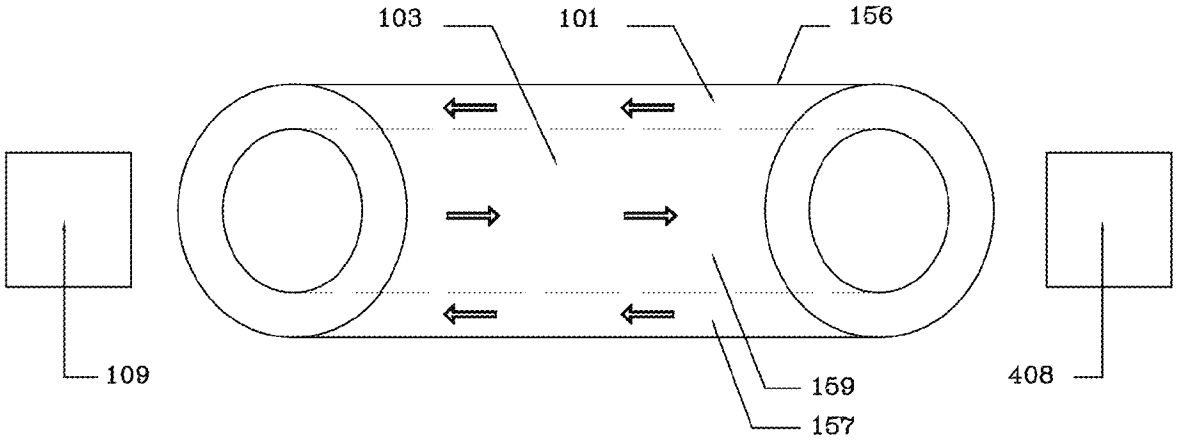
FIG. 9 illustrates a block diagram of the dual pipe heat exchange apparatus in accordance with one embodiment.

FIG. 9 is an illustrative block diagram of dual pipe heat exchange apparatus. In one embodiment, the refrigeration system 408 provides hot refrigerant 101 into the outer pipe 157 of a dual pipe 156 directed towards the evaporator 109. In another embodiment, the evaporator 109 provides cold refrigerant 103 into the inner pipe 159 of a dual pipe 156 directed towards the refrigeration system 408.

Figure 10:
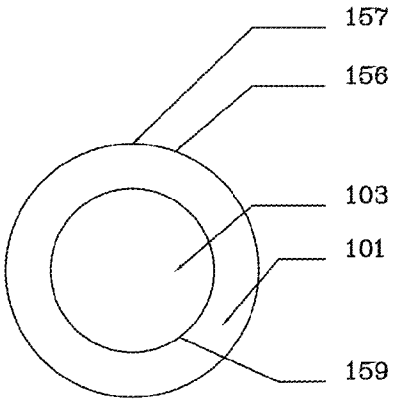
FIG. 10 illustrates a mid-view prospective of the dual pipe heat exchange apparatus in accordance with one embodiment.

FIG. 10 is an illustrative mid-view prospective of a dual pipe heat exchange apparatus. In one embodiment, the dual pipe 156 is comprised of an outer pipe 157 and an inner pipe. The outer pipe is comprised of a chamber between the exterior of the inner pipe 159 and the interior of the outer pipe 157. The inner pipe is comprised of a chamber comprised wholly of the inner pipe 159 cavity. The outer pipe is comprised of hot refrigerant 101 directed towards the evaporator. The inner pipe is comprised of cold refrigerant 103 directed away from the evaporator.

As will be apparent, the features and attributes of the specific embodiments disclosed above may be combined in different ways to form additional embodiments, all of which fall within the scope of the present disclosure. Although this invention has been described in terms of certain preferred embodiments and applications, other embodiments and applications that are apparent to those of ordinary skill in the art, including embodiments which do not provide all of the features and advantages set forth herein, are also within the scope of the invention. Accordingly, the scope of the present disclosure is intended to be defined only by the reference to the below claims.

What is claimed is:

1. An evaporator with heat exchange apparatus, comprising:

an inner casing configured to maintain:

a plurality of parallel tubes longitudinally disposed within the inner casing configured to maintain liquid for freezing into solid;

a plurality of parallel custom shaped solid tubes longitudinally disposed along the interior perimeter of the inner casing;

a center tube longitudinally disposed along the center of the inner casing;

an outer casing completely covering the inner casing in order to not permit the refrigerant to cross between the inner casing and the outer casing unless the refrigerant is provided by a first inlet means, configured to maintain refrigerant along a defined volume of space between the inner casing and the outer casing prior to entrance into the inner casing, comprising:

a perimeter chamber, comprising:

a defined volume of space between the inner casing and the outer casing along a side perimeter of the evaporator configured to receive refrigerant from an outer pipe;

wherein, the first inlet means configured to allow the refrigerant to enter the inner casing of the evaporator after exiting the outer casing and distribute the refrigerant within the inner casing of the evaporator.

2. The apparatus of claim 1, wherein the plurality of parallel custom shaped solid tubes longitudinally disposed along the interior perimeter of the inner casing are permanently adhered into position within the inner casing of the evaporator.

3. The apparatus of claim 1, wherein the center custom shaped hollow tube longitudinally disposed along the center of the inner casing is comprised of stainless steel.

4. The apparatus of claim 1, wherein the outer casing is comprised of stainless steel.

5. The apparatus of claim 1, wherein the outer pipe is a dual pipe heat exchange pipe.

6. The apparatus of claim 1, wherein the first inlet means is an expansion valve.

7. The apparatus of claim 1, wherein the center tube is hollow.

8. An evaporator with heat exchange apparatus, comprising:

a cylindrically shaped evaporator having a top and bottom side, comprising:

a cylindrically shaped inner casing having a top and a bottom side configured to maintain:

a plurality of parallel tubes longitudinally disposed within the evaporator configured to maintain liquid for freezing into solid;

a plurality of parallel custom shaped solid tubes longitudinally disposed along the interior perimeter of the inner casing;

a center custom shaped solid tube longitudinally disposed along the center of the inner casing;

a cylindrically shaped outer casing having a top and a bottom side covering the inner casing, configured to maintain refrigerant along a hollow space between the inner casing and the outer casing prior to entrance into the evaporator, comprising:

a perimeter chamber distributed along a perimeter side surface area of the evaporator between a perimeter outer side of the inner casing and a perimeter inner side of the outer casing configured to receive refrigerant from an outer pipe, a top chamber, and a bottom chamber;

the bottom chamber distributed along a bottom side surface area of the evaporator between a bottom outer side of the inner casing and a bottom inner side of the outer casing configured to receive refrigerant from the perimeter chamber;

the top chamber distributed along a top side surface area of the evaporator between a top outer side of the inner casing and a top inner side of the outer casing configured to receive refrigerant form the perimeter chamber;

a first outlet means configured along the bottom side of the evaporator to allow the refrigerant to exit the bottom chamber;

a second inlet means configured along the bottom side of the inner casing to allow the refrigerant to:

enter the inner casing; and distribute the refrigerant within the inner casing of the evaporator.

9. The apparatus of claim 8, wherein the plurality of parallel custom shaped solid tubes longitudinally disposed along the interior perimeter of the evaporator are permanently adhered into position within the inner casing of the evaporator.

10. The apparatus of claim 8, wherein the center custom shaped solid tube longitudinally disposed along the center of the inner casing is comprised of stainless steel.

11. The apparatus of claim 8, wherein the center custom shaped solid tube longitudinally disposed along the center of the evaporator acts as a space reducer to increase the cooling efficiency of the evaporator.

12. The apparatus of claim 8, wherein the outer casing is comprised of stainless steel.

13. The apparatus of claim 8, wherein the second inlet means is an expansion valve.

14. The apparatus of claim 8, wherein the first outlet means is a pipe leading to an external refrigeration system.

15. An evaporator with heat exchange apparatus, comprising:

an inner casing configured to maintain:

a plurality of parallel tubes longitudinally disposed within the inner casing configured to maintain liquid for freezing into solid;

a plurality of parallel custom shaped solid tubes longitudinally disposed along the interior perimeter of the inner casing;

a center custom shaped hollow tube longitudinally disposed along the center of the inner casing;

an outer casing, completely covering the inner casing in order to not permit the refrigerant to cross between the inner casing and the outer casing unless the refrigerant is provided by a first inlet means into the inner casing, configured to circulate refrigerant along a plurality of chambers around the evaporator, wherein each of the plurality of chambers utilize a defined volume of space to circulate and drop the temperature of refrigerant circulating within the outer casing prior to its entrance into the inner casing, comprising:

a perimeter chamber, comprising:

a defined volume of space between the inner casing and the outer casing along a side portion of the evaporator configured to receive refrigerant from an outer pipe;

a bottom chamber, comprising:

a defined volume of space between the inner casing and the outer casing along a bottom portion of the evaporator;

a center chamber, comprising:

a defined volume of space configured along the center of the evaporator alongside the center custom shaped hollow tube and the outer casing;

the top chamber, comprising:

a defined volume of space between the inner casing and the outer casing along a top portion of the evaporator;

the first inlet means configured to allow the refrigerant to:

enter the inner casing of the evaporator after exiting the outer casing; and distribute the refrigerant within the inner casing of the evaporator.

16. The apparatus of claim 15, wherein the plurality of parallel custom shaped solid tubes longitudinally disposed along the interior perimeter of the evaporator are permanently adhered into position within the inner casing of the evaporator.

17. The apparatus of claim 15, wherein the center custom shaped hollow tube longitudinally disposed along the center of the inner casing is comprised of stainless steel.

18. The apparatus of claim 15, wherein the outer casing is comprised of stainless steel.

19. The apparatus of claim 15, wherein the first inlet means is an expansion valve.

20. The apparatus of claim 15, wherein the outer pipe is a pipe leading to an external refrigeration system.

* * * * *